US007043860B2

(12) United States Patent
Inoue

(10) Patent No.: US 7,043,860 B2
(45) Date of Patent: May 16, 2006

(54) SYMBOL ILLUMINATOR OF GAME MACHINE

(75) Inventor: Fumio Inoue, Tokyo (JP)

(73) Assignee: Wing Co., Ltd., Tokyo (JP)

( * ) Notice: Subject to any disclaimer, the term of this patent is extended or adjusted under 35 U.S.C. 154(b) by 250 days.

(21) Appl. No.: 10/436,106

(22) Filed: May 13, 2003

(65) Prior Publication Data

US 2004/0200102 A1 Oct. 14, 2004

(30) Foreign Application Priority Data

Apr. 14, 2003 (JP) ..... P2003-109059

(51) Int. Cl.
*A63F 5/04* (2006.01)

(52) U.S. Cl. ..... 40/582; 463/20; 273/143 R

(58) Field of Classification Search ..... 273/143 R, 273/142 R, 138.1; 463/20; 40/430, 431, 40/433, 493, 506
See application file for complete search history.

(56) References Cited

U.S. PATENT DOCUMENTS 4,711,452 A * 12/1987 Dickinson et al. ..... 273/143 R
5,102,136 A * 4/1992 Heidel et al. ..... 273/143 R
5,688,172 A * 11/1997 Lorenzo Regidor ..... 463/20
6,102,396 A * 8/2000 Liu ..... 273/143 R
6,129,355 A * 10/2000 Hahn et al. ..... 273/142 R

FOREIGN PATENT DOCUMENTS

| | | |
|---|---|---|
| JP | 9-320534 | 12/1997 |
| JP | 11-155998 | 6/1999 |
| JP | 2003-29674 | 1/2003 |

* cited by examiner

*Primary Examiner*—Cassandra Davis
(74) *Attorney, Agent, or Firm*—Ronald E. Greigg

(57) ABSTRACT

A symbol illuminator of game machines includes a wheel member having symbols at an outer circumferential surface thereof; a casing for the wheel member attached a printed circuit board having a plurality of illuminants; and a reflective frame member having enclosure walls expanding outwardly to a forward direction from a central part thereof, having a plurality of windows into which the illuminants are set, the illuminants being arranged so as to project inside a center part of the reflective frame member; and a projection part, having a reflective face, reflecting the light emitted by the illuminants toward at least the symbol from the inner side of the wheel member so that it can irradiate a reflex of a reflective frame member equally without spots to the symbol of wheel member and can reduce the number of the parts.

10 Claims, 14 Drawing Sheets

SYMBOL ILLUMINATOR OF GAME MACHINE

BACKGROUND OF THE INVENTION

1. Field of the Invention

The present invention relates to a symbol illuminator of game machines such as pachinko game machines, game machines with wheel member and game machines with wheel reel. Especially, this invention is suited for the game machines provided the symbols around the wheel member.

2. Description of the Prior Art

Unexamined Japanese patent application publication No. 9-320534 (P1997-320534A) discloses one known symbol illuminator. In the reflective frame member indicated in FIG. 5 of this publication, an enclosure wall (upper, lower, right and left walls) extends forwardly from the central part formed in the shape of a vertical wall. A printed circuit board is fixed to the left wall of the enclosure wall, and two lamps locate inside the enclosure wall through sockets. The lighting part of the embodiment consists basically of the printed circuit board which has a plurality of lamps and a reflective frame member formed in the shape of a tray so that the light emitted by the lamps reflects in the inner surface of the enclosure wall, and the light is irradiated to the symbol of the wheel member. However, since the light emitted by the lamps reflects only in the inner surface of the enclosure wall in this embodiment, the diffusion efficiency is inadequate. Moreover, since the lamps project from the inner wall of the left wall so that it parallels the inner wall located at a central part, the direct light of the lamp is too strong, and the symbol is not uniformity irradiated resulting in spot illumination of the symbol.

Unexamined Japanese patent application publication No. 11-155998 discloses a reflective frame member indicated in FIG. 4 which consists of two or more reflective boards. Namely, the first reflective board is generally U-shaped while the second reflective board is generally L-shaped and the third reflective board is arranged individually at the outer portion of the wheel member formed in the shape of a rotational reel. In this embodiment, although the reflex of the reflective member can be irradiated equally to the symbol without a spot, there are too many reflective boards and the combination of each part is not easy.

Unexamined Japanese patent application publication No. 2003-29674 discloses a device in which the printed circuit board with two or more light emitting diodes is attached behind the enclosure wall, and the light emitting diodes are arranged into the enclosure wall. The light emitted by the light emitting diodes reflects the inner wall surface of the enclosure wall of and is irradiated from the inside of the wheel member to the symbol. In this embodiment, there is the same problem as in publication No. 9-320534, so that it is necessary to provide a light diffusion sheet between the light emitting diode and a display sheet.

SUMMARY OF THE INVENTION

Accordingly, it is an object of the invention to provide a symbol illuminator of a game machine that can irradiate a reflex of a reflective frame member equally without uniformly illuminated spots to the symbol of wheel member that is located in the display window of a game machine. In other wards, the light from a plurality of illuminants is diffused in all the directions using the outer wall reflective face of the projection part located in the middle of the reflective face of an enclosure wall and an illuminant, and the visibility of a player is improved. It is another object of the invention to provide a symbol illuminator of a game machine that can reduce the number of parts, and a printed circuit board and a reflective frame member can be attached fixedly and stably. It is further object of the invention to provide a symbol illuminator of a game machine that a printed circuit board and a reflective frame member can be connected easily.

The term "enclosure wall" has a concept of a central part and includes a surrounding wall of a cone-shaped hollow, a bugle-shaped surrounding wall, polygonal surrounding wall having top, bottom, left and right walls and a surrounding wall of an elliptical shape. Moreover, the term "central part" includes a perpendicular wall and a slightly curved wall. Moreover, the term "projection part" includes a part which extends to an opening edge of the enclosure wall from the central part thereof and includes the partition wall with a reflective face corresponds to each illuminant. The term "projection part formed in the shape of the partition wall" means to form widely the reflective face with a mountain form in cross section, unlike the partition wall provided in order to prevent interference of the light emitted from each illuminant. Therefore, when the size of the height scales down and the projection part is not extended to the end portion of the enclosure wall, for example, the light reflected by the projection part of the shape of the partition wall and the light which is not influenced by the projection part are generated. In addition, the central part of the enclosure wall is formed an inclination wall or horizontal wall, depending on the arrangement of the reflective member.

BRIEF DESCRIPTION OF THE DRAWINGS

Other features and advantages of the invention will become apparent from the detailed description contained herein below, taken in conjunction with the drawings, in which.

DETAILED DESCRIPTION OF THE PREFERRED EMBODIMENTS

Figure 1:
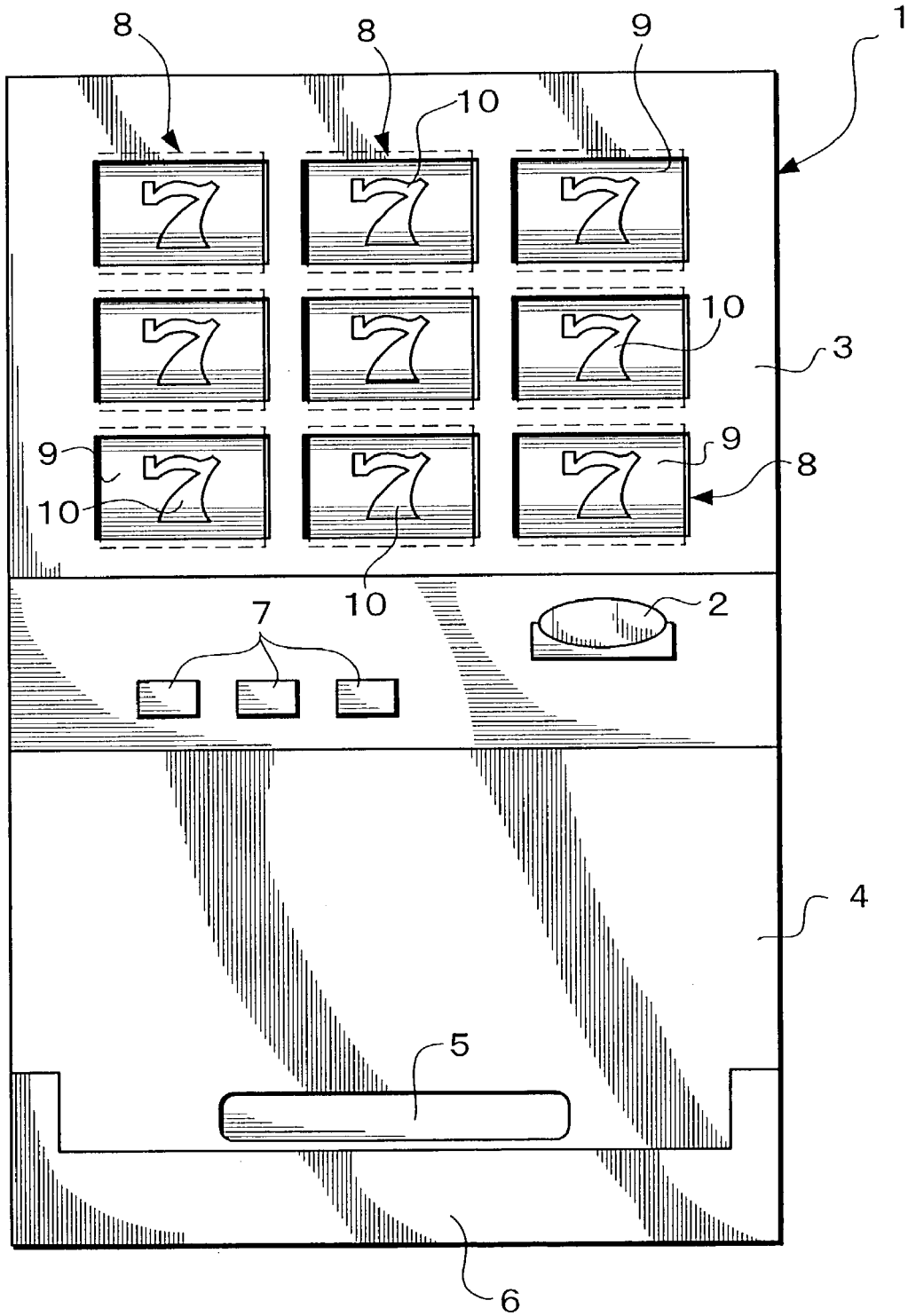
FIG. 1 is a schematic front view of a game machine that is applicable in this invention.

An understanding of the present invention may be best gained by reference to FIGS. 1–10, in which FIG. 1 shows a schematic front view of a game machine (such as, for example slot machine) which is applicable in the present invention.

The appearance of the game machine 1 is explained briefly. The numeral 2 shows a medal slot provided at a central portion thereof; numeral 3 shows an upper panel provided at an upper portion of the medal slot 2; numeral 4 shows a lower panel provided at a lower portion of the medal slot 2; numeral 5 shows a medal return; and numeral 6 shows a medal receivable part. The numeral 7 shows means for operating with touching, provided at the central portion thereof. A plurality (nine pieces, for example) of symbols 10 (numbers, figures etc.) of a wheel member 9 can be watched through a display window 8 of the upper panel 3. When the operation means 7 is operated, the wheel member 9 rotates and stops via a control means, a drive motor and the like which are not be illustrated.

In addition, each form of the display window 8 is not limited to a quadrangle. For example, any shape of the display window 8 such as a hexagon shape, an ellipse shape and circular shape may be formed. Moreover, the style of the symbol also may change corresponding to each size and form of the display window 8.

Figure 2:
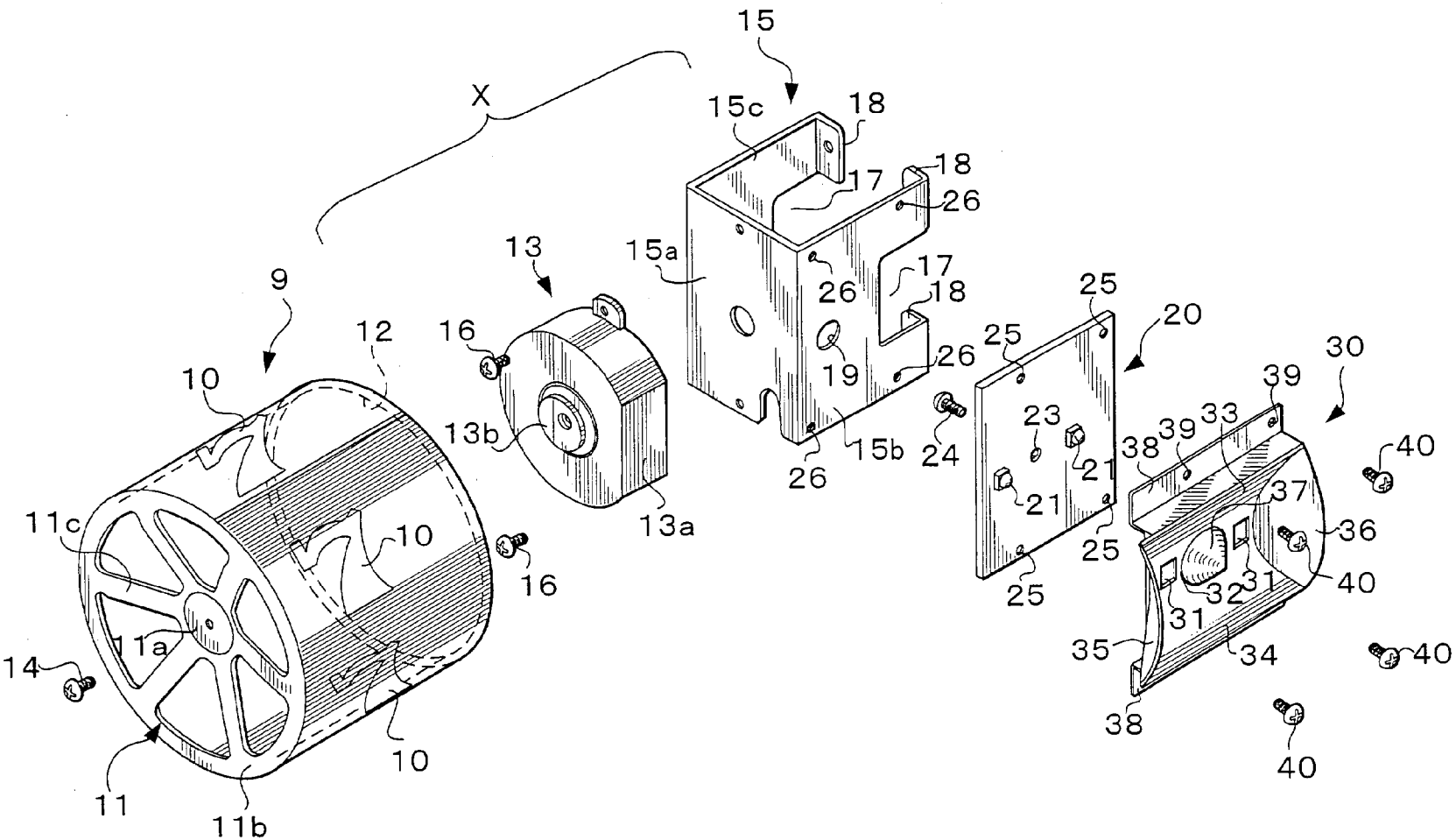
FIG. 2 is a exploded perspective view showing a first embodiment of the present invention.
Figure 3:
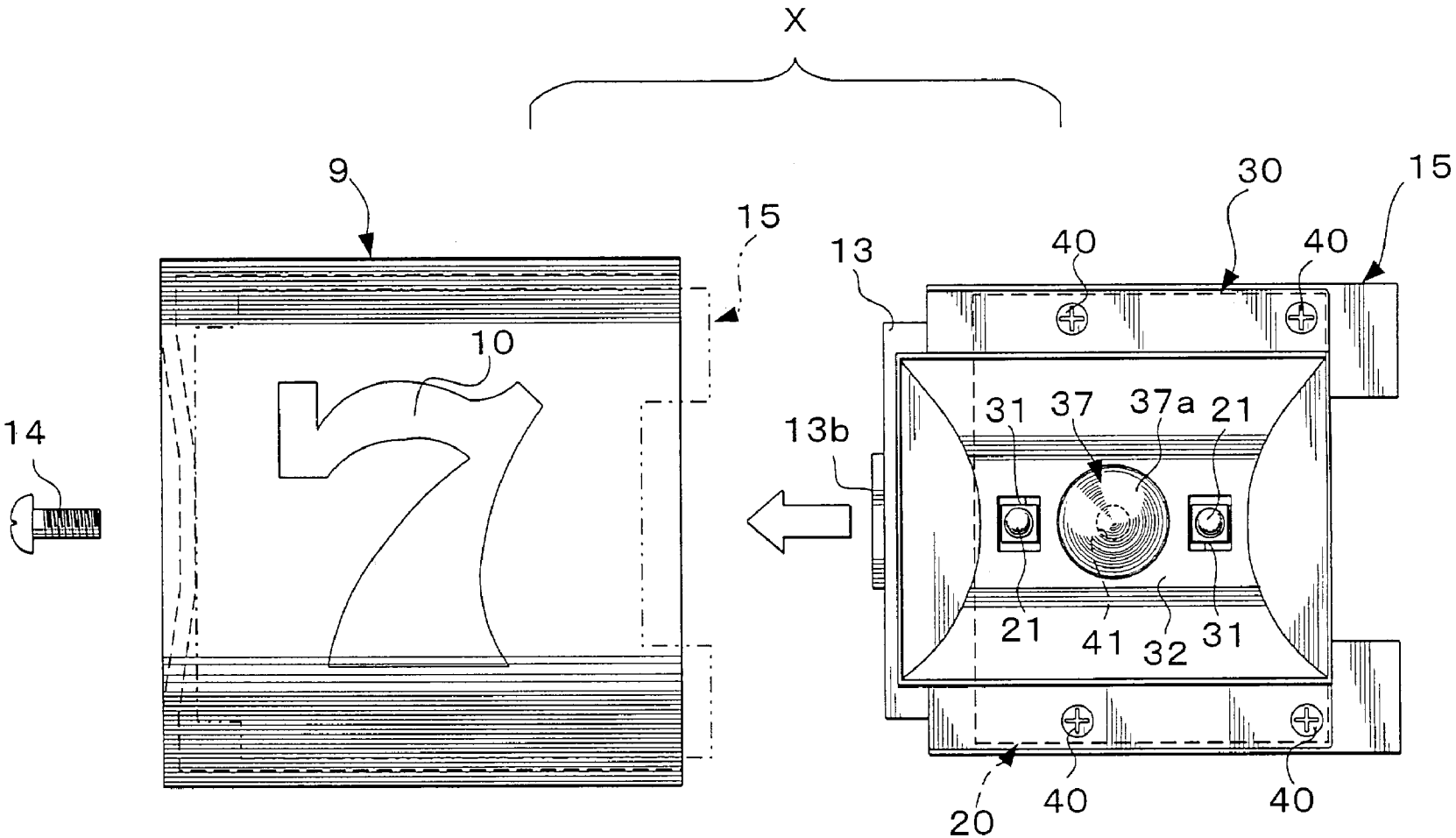
FIG. 3 is an exploded view showing a relationship between a revolving member and the other members.
Figure 4:
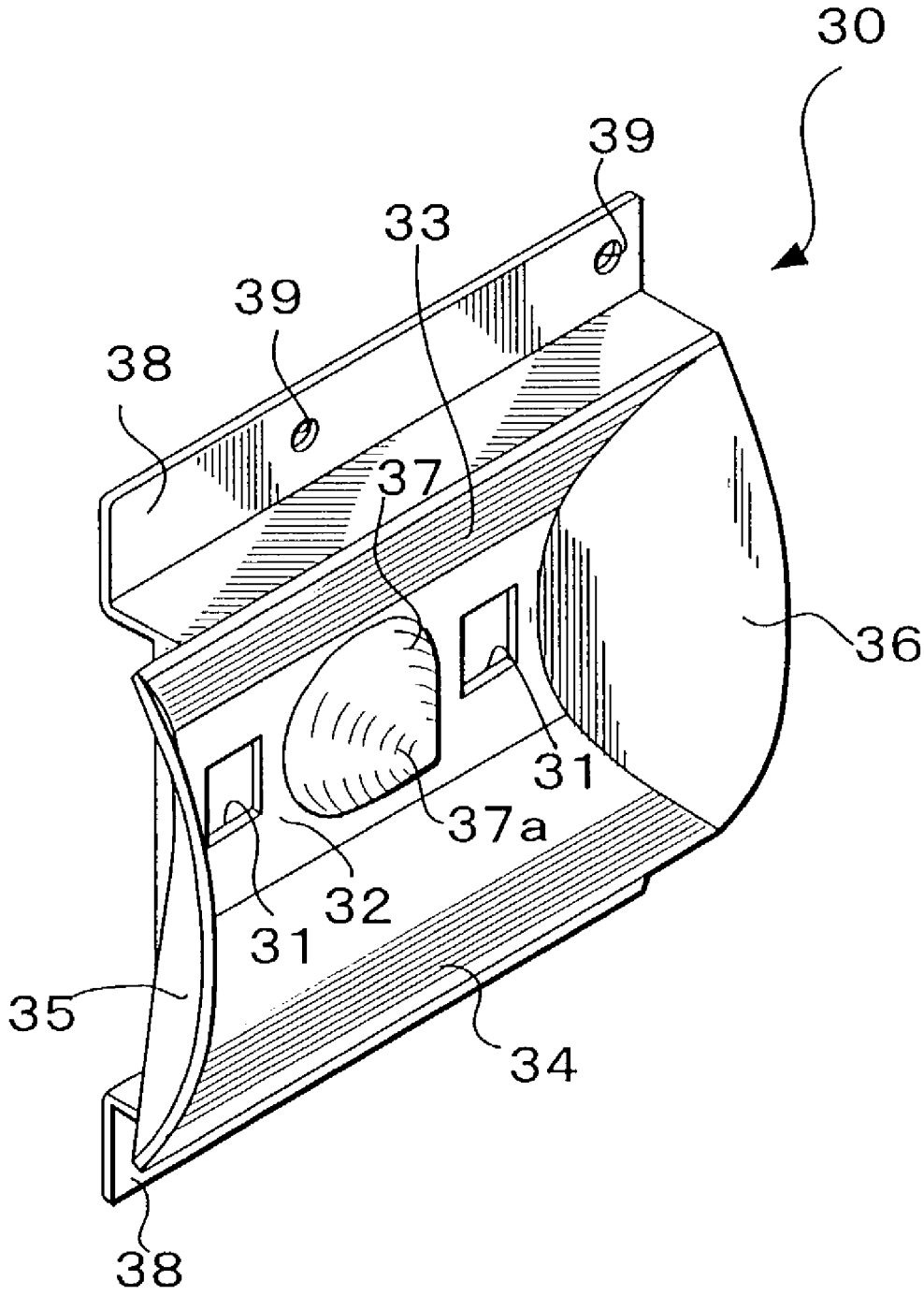
FIG. 4 is a perspective view of a reflecting frame member.
Figure 5:
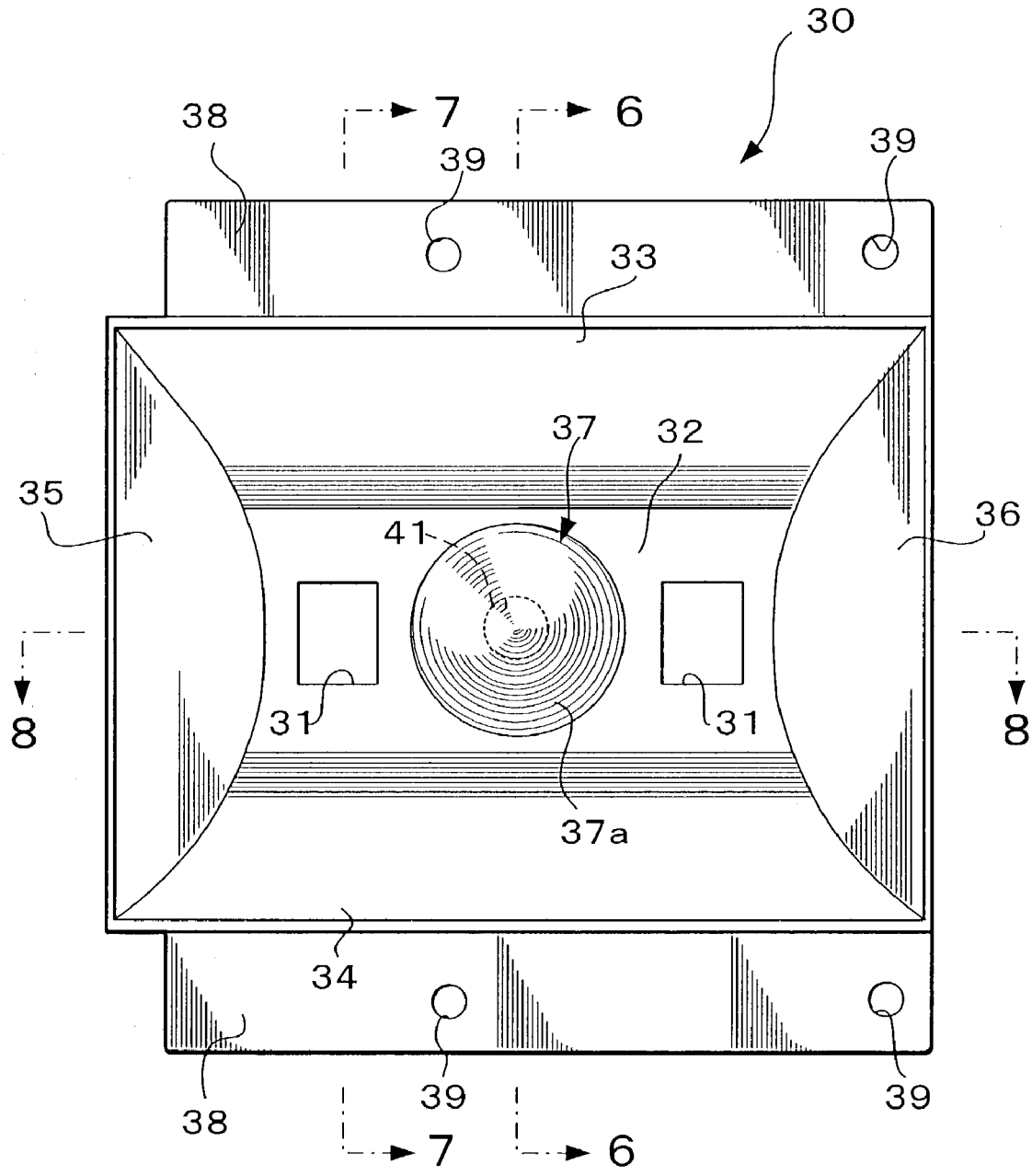
FIG. 5 is a front view of a reflecting frame member.

As shown in FIG. 2 and FIG. 3, the main components of the present invention are installed in the wheel member 9 arranged at each display window 8 of the game machine 1. The symbol illuminator X of the present invention is explained. The numeral 9 shows the wheel member 9 formed in the shape of a pipe, having symbols 10 at an outer circumferential surface thereof. An attachment part 11 for a drive motor is attached at one end opening of the wheel member 9. The attachment part 11 includes a center part 11*a* formed in the shape of a circular disc or hub, having the singular number or two or more screw holes; a ring part 11*b* which is located at an outer portion thereof; and a plurality of arms 11*c* which connect radially with the center part 11*a* and ring part 11*b*. The other end portion of the wheel member 9 is open as shown at 12 so as to enable installation of a frame, drive motor, reflective frame member and the like.

The numeral 13 indicates a drive motor such as a stepping motor, for example. The drive motor 13 has a shaft 13*b* in the central part of a case 13*a*. The shaft 13*b* is associated with the wheel member 9 via the attachment part 11 formed in the shape of a frame and a first mounting screw 14. Therefore, when the shaft 13*b* rotates, the wheel member 9 is also rotated.

The numeral 15 indicates a casing for the wheel member. The drive motor 13 is mounted on an outer surface of side walls 15*a* of the casing 15 by way of projecting tabs on the upper and lower portions of the case 13*a*, and a plurality of second mounting screws 16. Therefore, the wheel member 9 formed in the shape of a reel is indirectly fixed to the casing 15 through the drive motor 13. Also the casing 15 includes an axle hole, a screw hole, a cutout or access slot for wiring, and mounting holes for mounting screws and the like.

When the left wall 15*a* of the casing 15 shown in FIG. 2 is explained basically, the upper and lower portions of the casing 15 are opened widely. The numeral 15*b* shows a front wall that intersects perpendicularly with the left wall 15*a*. The front wall 15*b* has a cutout portion 17 formed in the shape of a rectangle extending from the right end portion thereof to a location adjacent a central portion thereof. Moreover, the upper and lower portions of the right end of the front wall 15*b* are provided flanges or end plates 18 and 18 which extend inwardly from wall 15*b*. Moreover, the access hole 19 for a mounting screw mentioned later is formed at the portion adjacent the central part of the front wall 15*b*.

In addition, the numeral 15*c* indicates a back wall that intersects perpendicularly with the left wall 15*a*. The back wall 15*c* locates opposite to the front wall 15*b*. Since the back wall 15*c* is substantially the mirror image of the front wall 15*b*, the same reference numerals are given to the corresponding parts. The casing 15 is fixed to a support member into the game machine 1 through the end plates 18 and 18.

The numeral 20 indicates a printed circuit board having a plurality of illuminating elements, or illuminants 21 and 21 (two illuminants, for example) attached to a center portion thereof. The illuminants 21 and 21 are arranged at a predetermined space at a horizontal line, and they are attached offset slightly at a portion adjacent the left end part of the printed circuit board. The printed circuit board 20 is formed in the shape of a quadrangle and formed the same size substantially of the front wall 15*b* of the casing 15.

The printed circuit board 20 includes a plurality of small holes, that is, the numeral 23 shows a through hole formed at a middle portion of the illuminants 21 and 21. The through hole 23 receives a third mounting screw 24 through the fit hole 19 from an inner wall of the front wall 15*b* of the casing 15. The third mounting screw 24 is screwed into a screwed hole 41 of a projection part 37 for reflection of a reflective frame member 30.

Therefore, the printed circuit board 20 is fixed to the reflective frame member 30 via the third mounting screw 24. In addition, the numeral 25 indicates a plurality of through holes formed at a predetermined interval at the upper and lower ends of the printed circuit board 20. Four through holes 25 correspond to screw holes 26 formed at the upper and lower ends of the front wall 15*b* of the casing 15 and are provided offset at portions adjacent the right end part of the printed circuit board 20.

The numeral 30 indicates the reflective frame member and has a plurality of small windows 31 and 31 that receive the illuminants 21 and 21 thereinto. The enclosure walls 33, 34, 35 and 36 provided at an upper, lower, right and left portions expand outwardly to a forward direction from the central part 32 formed in the shape of a vertical wall. In this embodiment, the reflective frame member 30 is formed as a vertical wall with a tray shape at the center part 32 thereof.

Moreover, an opening edge of the reflective frame member 30 is formed in the shape of a rectangle, and the right and left walls 35 and 36 of the equivalent to the parts of the enclosure walls are curved outwardly. The term "enclosure wall" includes a surrounding wall of a cone-shaped hollow, a bugle-shaped surrounding wall, polygonal surrounding wall having top, bottom, left and right walls, a surrounding wall of an elliptical shape such as a bank for running of a bicycle race.

The enclosure walls 33, 34, 35 and 36 are curved at a part or all parts thereof in order to raise reflective efficiency. Furthermore, oblong attachment plates or flanges 38 and 38 project from in the outer edges of the upper and lower walls 33 and 34.

The numeral 39 shows a plurality of attachment holes which are formed at attachment plates 38 and 38 with angular L letter shape at a predetermined intervals. The attachment holes 39 correspond to the through hole 25 of the printed circuit board 20 and the screw holes 26 of the casing 15. The reflective frame member 30 is stably fixed to the casing 15 through the through holes 25, 26 and 39 and fourth mounting screws 40.

Therefore, the printed circuit board 20 is sandwiched between the front wall 15*b* of the casing 15 and the attachment plates 38 and 38 of the reflective frame member 30. When the printed circuit board 20 associates with the casing 15, two illuminants 21 and 21 jump out from the small windows 31 and 31 of the central part of the reflective frame member.

Figure 6:
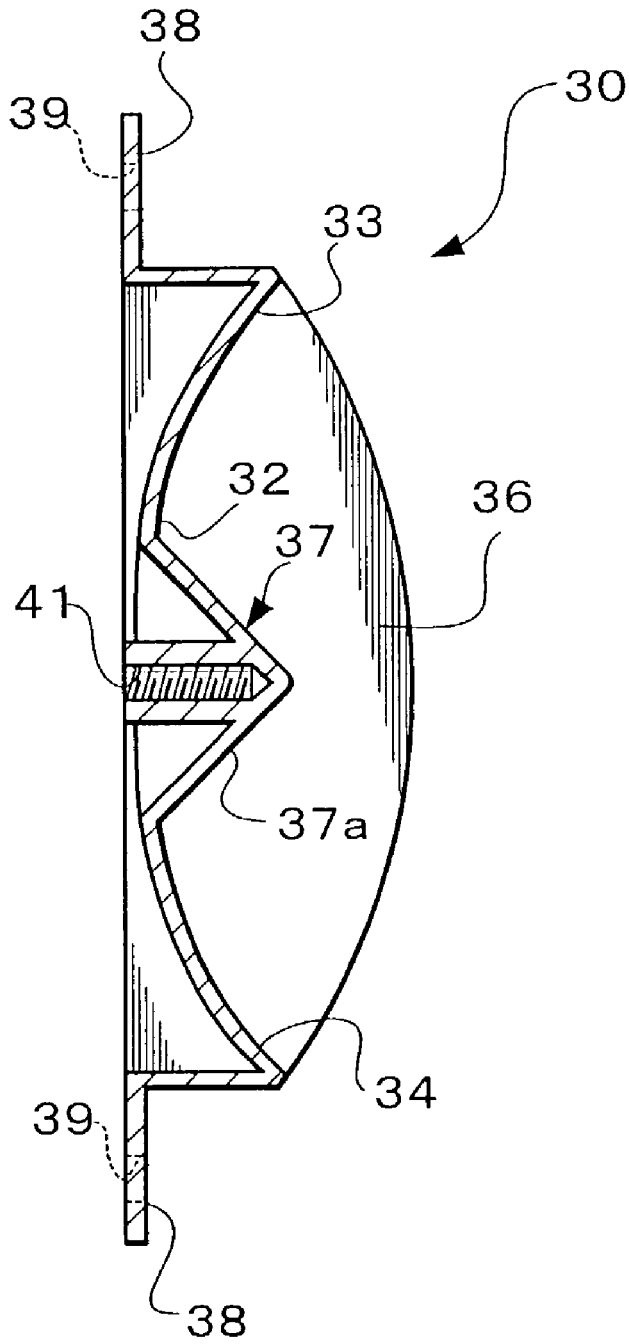
FIG. 6 is a schematic cross sectional view taken along the line 6—6 of FIG. 5.
Figure 7:
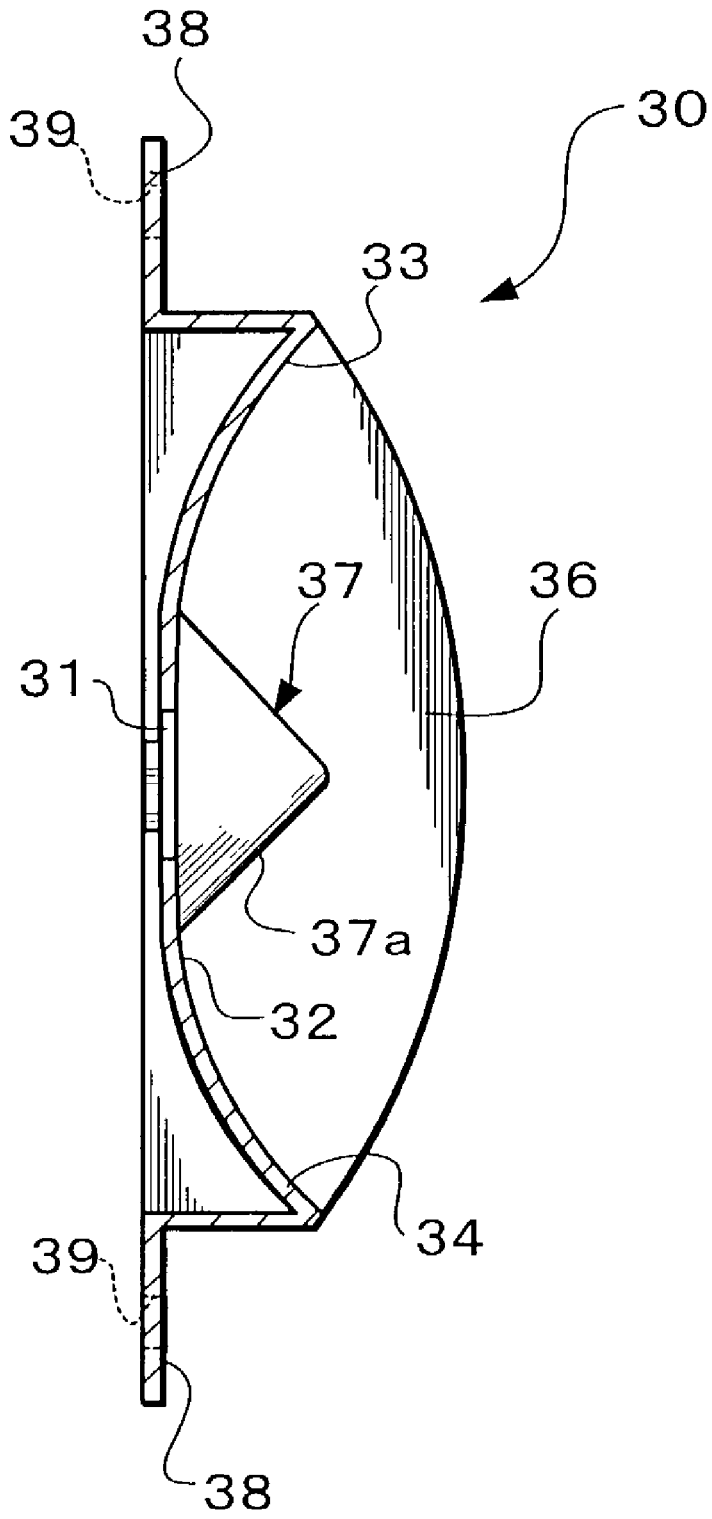
FIG. 7 is a schematic cross sectional view taken along the line 7—7 of FIG. 5.
Figure 8:
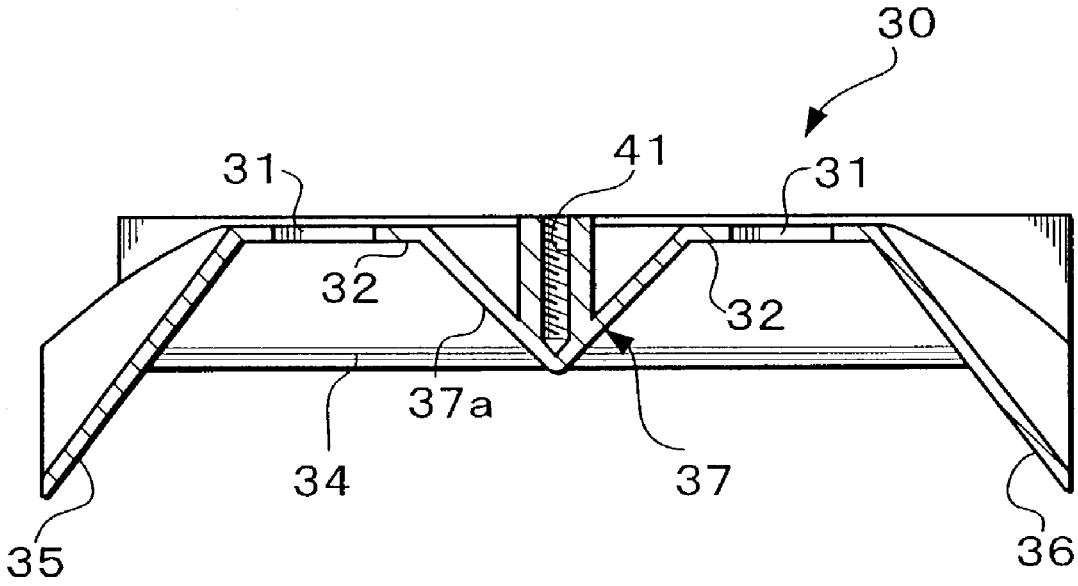
FIG. 8 is a schematic cross sectional view taken along the line 8—8 of FIG. 5.

The numeral 37 shows the projection part that is installed between the illuminants 21 and 21, having a reflective face 37*a* formed in the shape of a cone or pyramid, reflecting the light emitted by the illuminants 21 and 21 toward the symbol 10 from the inner side of the wheel member 9. In this embodiment, the reflective face 37*a* is formed in the shape of the cone. As shown in FIG. 6, the projection part is formed in the shape of a mountain in cross section, and the screwed hole 41 in which is screwed the third mounting screw 24 is formed therein.

Figure 9:
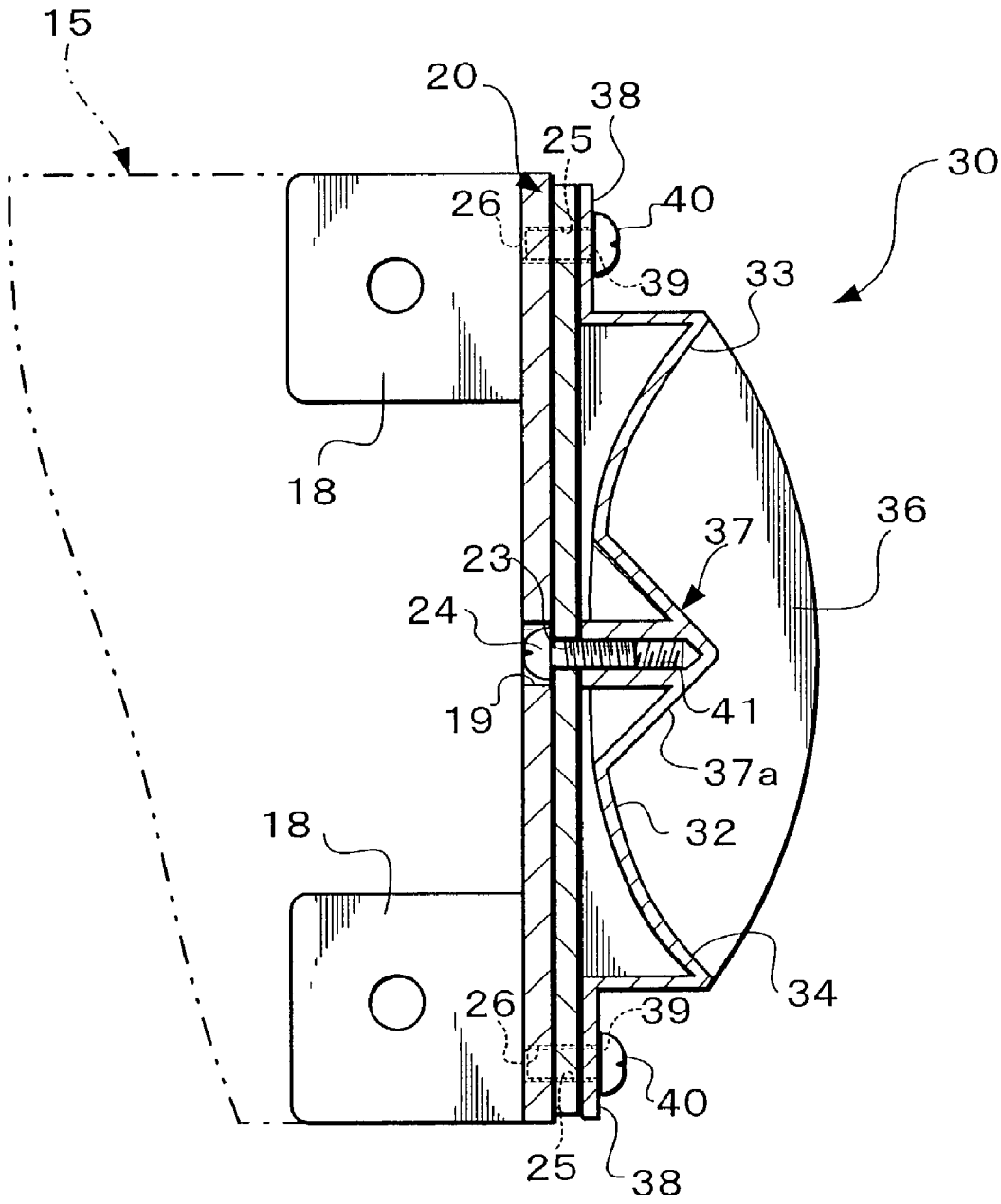
FIG. 9 is a schematic explanation view showing the way in which a printed circuit board is connected to a reflecting frame member.

FIG. 9 is an explanation view showing the way in which the reflective frame member 30 is fixed to the casing 15. Since the reflective frame member 30 is fixed to the surface of a printed circuit board 20, the attachment hole 39 of the reflective frame member 30 is put upon the through hole 25 of the printed circuit board 20. The third mounting screw 24 is inserted into the through hole 23 located at the center part of the printed circuit board 20 and screwed into the screwed hole 41 of the reflective frame member 30. The printed circuit board 20 is separately associated with the reflective frame member 30. The attachment hole 39 of the reflective frame member is aligned with the screw hole 26, and the fourth mounting screw 40 is screwed into the screw hole 26.

After the printed circuit board 20 and the reflective frame member 30 are attached to the front wall 15*b* of the casing 15, the head of the third mounting screw 24 fits the fit hole 19 of the casing 15. Therefore, the third mounting screw 24 is not an obstruction. The printed circuit board 20 and the reflective frame member 30 are attached certainly to the casing 15.

Figure 10:
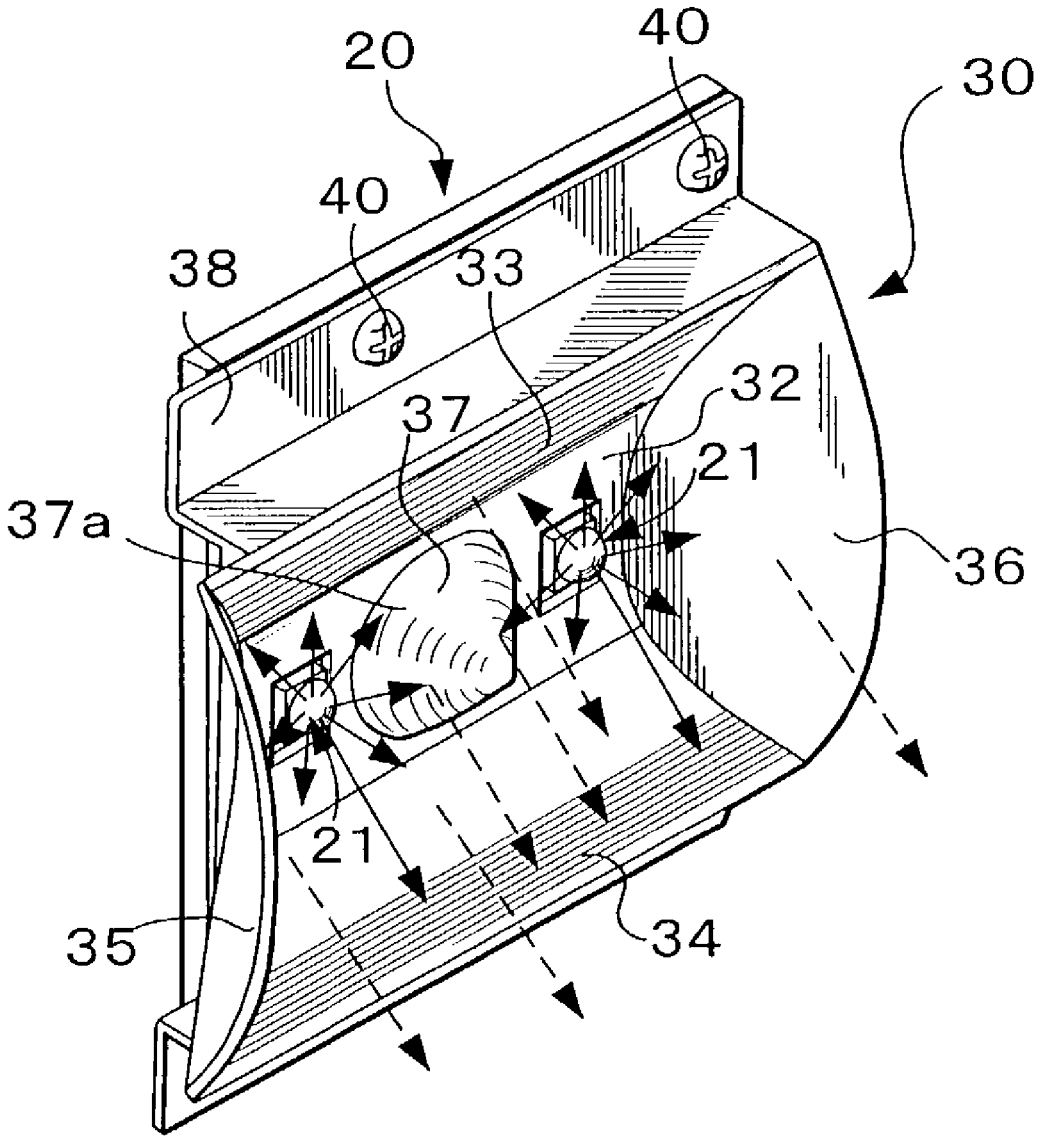
FIG. 10 is ax perspective view showing an action of irradiation.

Next, FIG. 10 shows the explanation view of a relation between the reflective frame member 30 and the illuminant 21. The illuminant 21 is the Light Emitting Diode (LED) diffusing in the large range in this embodiment so that the light is emitted in all the directions by the short arrow, for example. The light emitted by the LED has the direct light (solid line arrow) directly irradiated to the symbol 10 of the wheel member 9 which is located in the display window of the game machine and the reflex (dotted line arrow) indirectly irradiated to the symbol 10 after reflecting in the outer wall 37*a* of the projection part 37 and the inner wall of the enclosure wall of the reflective frame member 30.

In this embodiment, the inner surfaces of the enclosure walls 33, 34, 35 and 36 are the reflective face. Moreover, the outer wall 37*a* of the projection part 37 is also the reflective face. The solid line arrows and dotted line arrows are shown for illustration purposes. In the light emitted by the LED, the reflection is equally irradiated without spots (not spot) to one symbol 10 of the wheel member 9 which is located at the display window 8.

Although the wheel member 9 is formed in the shape of a reel, it is not limited such shape. An endless, driven belt that rotates through a plurality of guide rollers may be used. The central part of the reflective frame member 30 is formed as the vertical wall, and it may be formed slightly curved shape. The projection part of the reflective frame member 30 is formed in the shape of the mountain, in cross section.

The term "mountain shape in cross section" means a shape of a reflective face of the outer wall having a function to diffuse the light emitted by the illuminants widely, including a simple conical shape in cross section, a pyramidal trapezoid shape in cross section, a semicircle ball shape in cross section, a spherical segment shape in cross section and the like.

Figure 11:
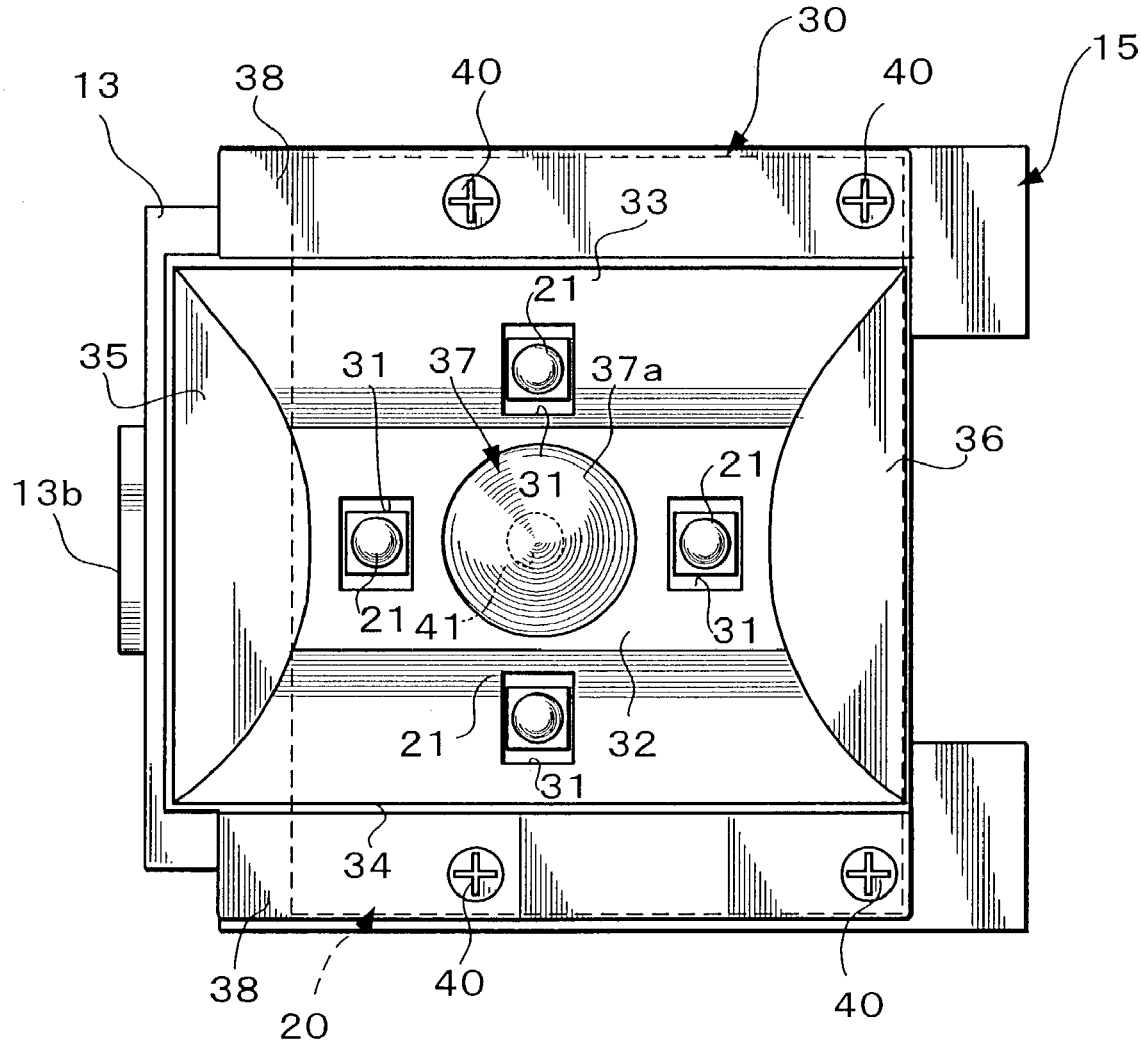
FIG. 11 is a variation including a first embodiment (four illuminants)

The projection part located in the middle of the illuminants may be used the plural number, halved types etc. Moreover, since the dimension of the projection part can be suitably set up in consideration of the form of the reflective face or enclosure wall, the intensity of the light emitted from the illuminant and the like, the size is also not limited. In brief, as shown in FIG. 11, the projection part 37 should be located between the plurality of the illuminants 21 (four pieces, for example). In the embodiment shown in FIG. 11, four illuminants 21 are arrange suitably at the printed circuit board 20, each illuminant 21 projects in the enclosure walls 33, 34, 35 and 36 from the small window 31A formed concentrically of the projection part 37 of the reflective frame member 30.

Moreover, at least some parts of the enclosure walls of the reflective frame member are curved outwardly or inwardly.

Other embodiments of the present invention will now be described with reference to FIGS. 12–14. In FIGS. 12–14, the same components as in the first embodiment described above with reference to FIGS. 12–14 are designated by the same reference numerals and therefore will not be further explained in great detail.

Figure 12:
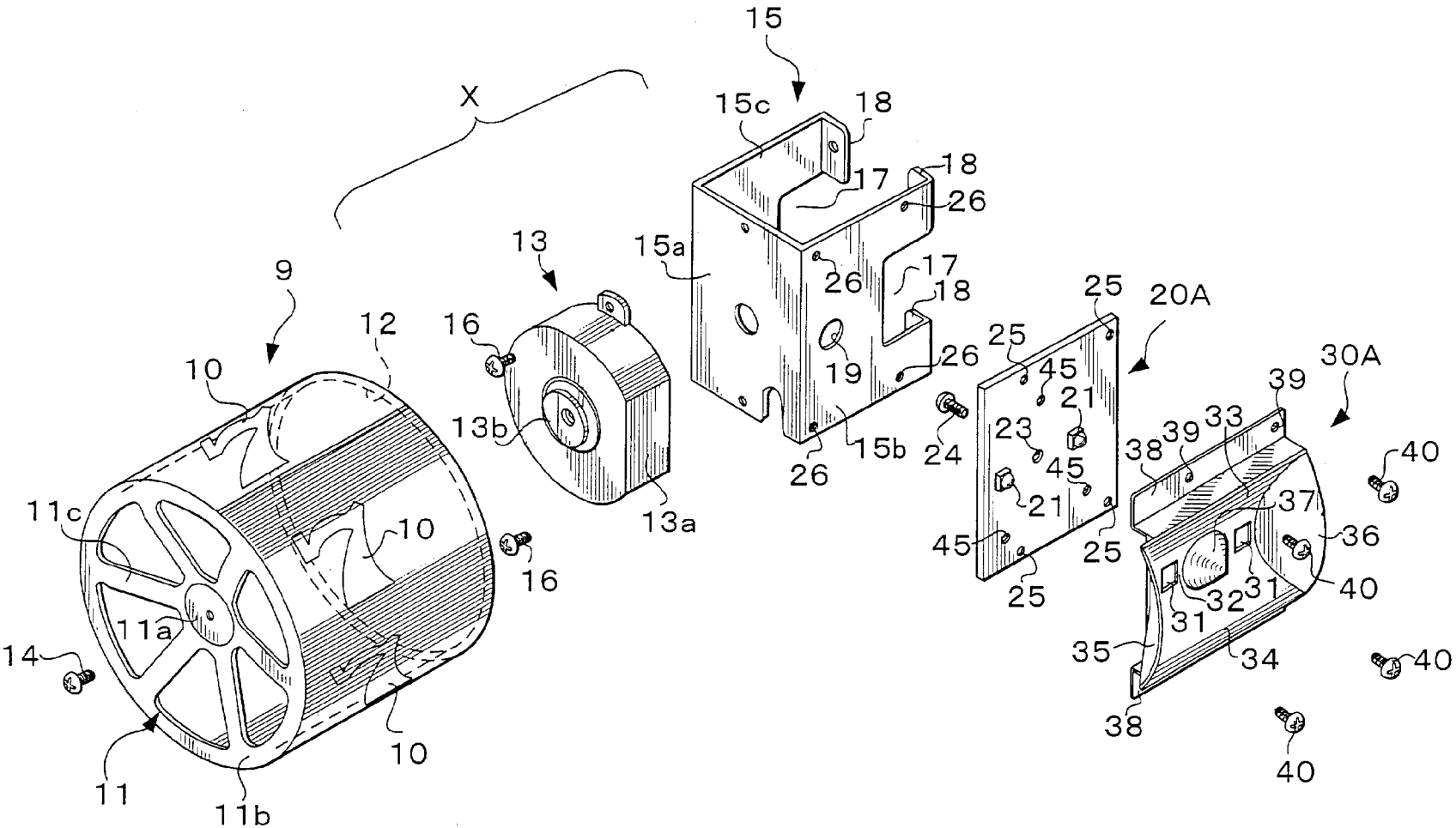
FIG. 12 is an exploded perspective view showing a second embodiment of the present invention.
Figure 13:
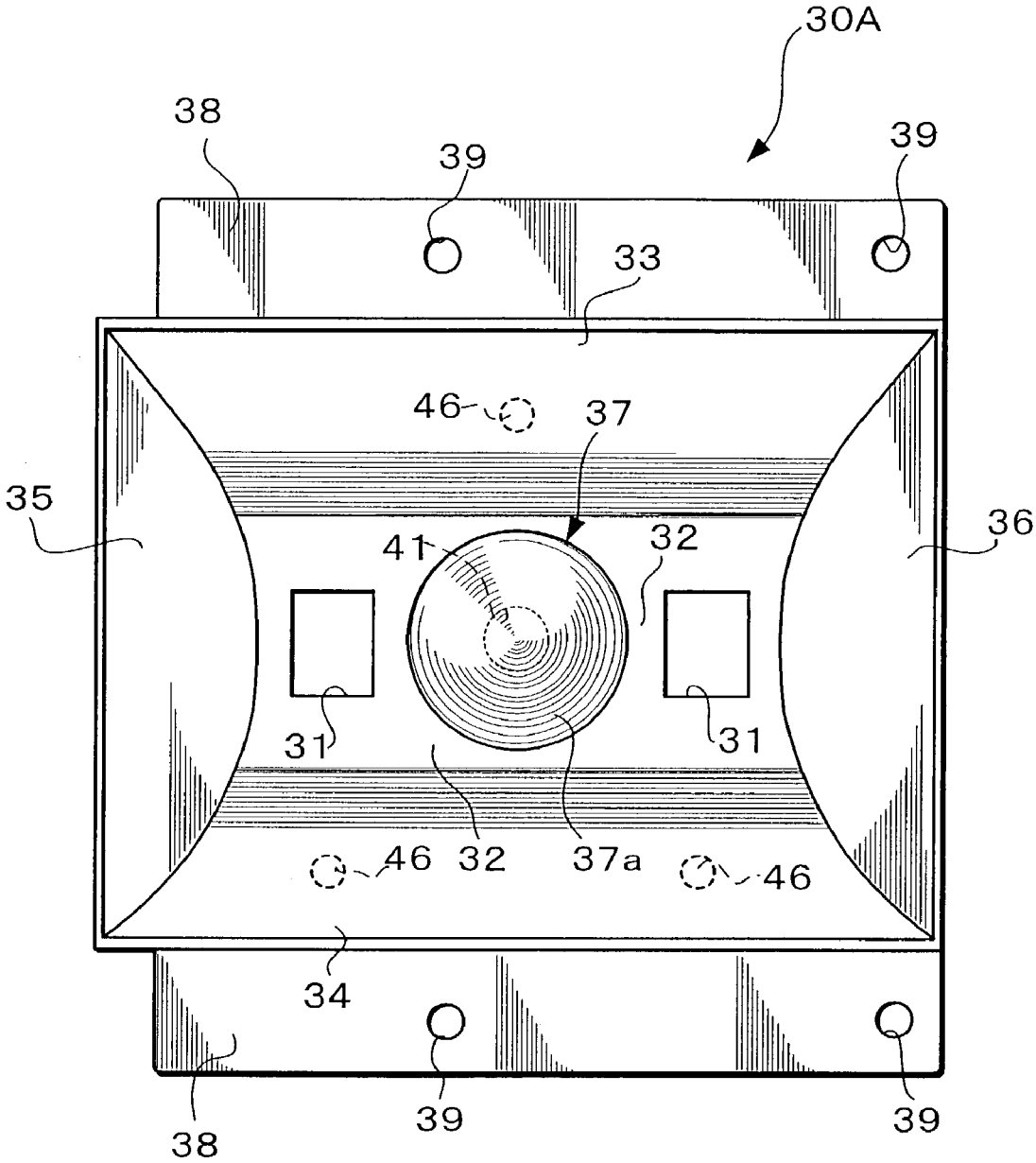
FIG. 13 is an explanation view in front.
Figure 14:
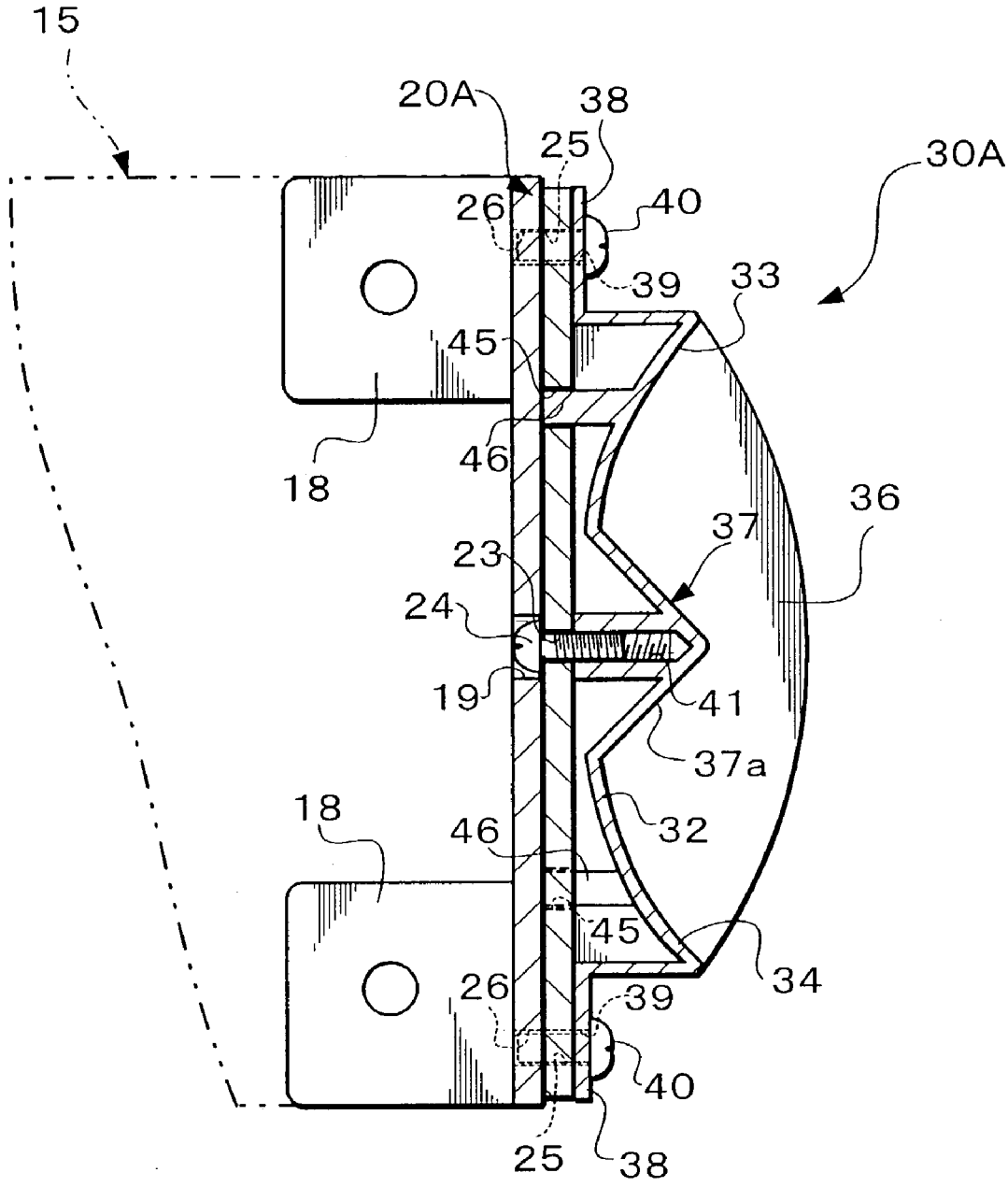
FIG. 14 is a schematic cross sectional view showing the way in which a printed circuit board is connected to a reflecting frame member.

A second embodiment of the present invention is shown in FIGS. 12–14. It is distinguished from the first embodiment in that a printed circuit board 20A is connected to a reflective frame member 30A simply.

Then, a plurality of engaged parts 45 (engage hole, for example) for positioning are formed at a printed circuit board 20A, and a plurality of engage parts 46 (engage projection, for example) which engage with the engaged parts 45 are formed at a reverse-side of the reflective frame member 30A.

Therefore, in the second embodiment, when the engage parts 46 of the reflective frame member 30A are set in the engaged parts 45, the through hole 23 of the printed circuit board 20A corresponds to the screwed hole 41 of the projection part 37 of the reflective frame member 30A so that the printed circuit board 20A and reflective frame member 30A are connected easily through the third mounting screw 24.

As set forth above, the advantages of the invention are as follows:

(1) The symbol illuminator of game machines can irradiate a reflex of the reflective frame member equally without spots (not spot) to the symbol of the wheel member which is located at the display window of the game machine. Therefore, when a player looks at the symbols, he can look at wholly the symbol of a display window which is uniformly illuminated.

(2) The light emitted by the illuminants can be efficiently spread using the reflective face of one reflective frame member and one or more projection parts located at the middle of the illuminants. Moreover, the number of the parts can be reduced, and the combination of each parts performs easy.

(3) In the second embodiment, the printed circuit board 20A is connected to the reflective frame member 30A simply.

The foregoing relates to preferred exemplary embodiments of the invention, it being understood that other variants and embodiments thereof are possible within the spirit and scope of the invention, the latter being defined by the appended claims.

What is claimed is:

1. A symbol illuminator of a game machine comprising a wheel member having symbols at an outer circumferential surface thereof, and also having an inner side;

a casing for the wheel member;

a printed circuit board attached to the casing, and having a plurality of illuminants;

a reflective frame member having enclosure walls expanding outwardly in a forward direction from a central part thereof, the reflective frame member having a plurality of windows receiving the illuminants thereinto, the illuminants being arranged so as to project inside a center part of the reflective frame member; and a projection part, having a reflective face, reflecting the light emitted by the illuminants toward at least one symbol from the inner side of the wheel member.

2. A symbol illuminator of a game machine according to claim 1, wherein at least some parts of the enclosure walls of the reflective frame member are curved outwardly or inwardly.

3. A symbol illuminator of a game machine according to claim 1, wherein the projection part is substantially cone shaped in cross section, and is located at the middle of the illuminants, which illuminants project through the windows.

4. A symbol illuminator of a game machine according to claim 1, wherein the reflective face of the projection part is formed in the shape of a cone.

5. A symbol illuminator of a game machine according to claim 1, wherein the reflective face has a plurality of reflective areas, each of which corresponds to one of the illuminants.

6. A symbol illuminator of a game machine according to claim 1, wherein the projection part further includes a screwed hole which corresponds to a through hole for a mounting screw formed at the printed circuit board, and the printed circuit board is associated with the reflective frame member via the mounting screw which screws into the through hole and screwed hole.

7. A symbol illuminator of a game machine according to claim 1, wherein the enclosure walls constitute a surrounding wall formed in of a polygonal shape having top, bottom, left and right walls.

8. A symbol illuminator of a game machine according to claim 1, wherein an opening edge of the reflective frame member is formed in the shape of a rectangle, and attachment plates are provided for attaching the reflective frame member to the circuit board.

9. A symbol illuminator of a game machine according to claim 8, wherein the printed circuit board is sandwiched between a front wall of the casing and the attachment plates of the reflective frame member via a plurality of mounting screws.

10. A symbol illuminator of a game machine according to claim 1, further comprising engaged parts for positioning formed at the printed circuit board; and engage parts which engage with the engaged parts which are formed at a reverse-side of the reflective frame member.

* * * * *